United States Patent [19]

Ruhnke

[11] Patent Number: 4,789,103

[45] Date of Patent: Dec. 6, 1988

[54] FAUCET AERATOR

[76] Inventor: Gottfried Ruhnke, Eduard-Wilhelmi-Strasse 8, D-6204 Taunusstein 4, Fed. Rep. of Germany

[21] Appl. No.: 910,976

[22] Filed: Sep. 24, 1986

[30] Foreign Application Priority Data

Sep. 25, 1985 [DE] Fed. Rep. of Germany ..... 3534113

[51] Int. Cl.[4] ..... E03C 1/084

[52] U.S. Cl. ..... 239/428.5; 239/553.3

[58] Field of Search ..... 239/428.5, 553.3, 590.3

[56] References Cited

U.S. PATENT DOCUMENTS

| | | | |
|---|---|---|---|
| 2,541,854 | 2/1951 | Bachli et al. | 239/590.3 X |
| 2,643,104 | 6/1953 | Holden | 239/590.3 X |
| 2,998,933 | 9/1961 | Aghnides | 239/428.5 |
| 3,067,953 | 12/1962 | Aghnides | 239/428.5 |
| 3,334,818 | 8/1967 | Moen | 239/428.5 |
| 3,531,051 | 9/1970 | Classen | 239/428.5 |
| 3,537,651 | 11/1970 | Classen | 239/428.5 |
| 3,851,825 | 12/1974 | Parkison et al. | 239/590.3 |
| 4,365,755 | 12/1982 | Aghnides | 239/428.5 |

FOREIGN PATENT DOCUMENTS

| | | | |
|---|---|---|---|
| 1178993 | 5/1959 | France | 239/553.3 |
| 1100372 | 1/1968 | United Kingdom | 239/428.5 |

*Primary Examiner*—Andres Kashnikow
*Assistant Examiner*—Mary Beth O. Jones
*Attorney, Agent, or Firm*—Charles E. Brown; Charles A. Brown

[57] ABSTRACT

A faucet aerator having a cylindrical housing with air openings therein and a lenticular screen arrangement in the housing downstream from the openings. The screen arrangement comprises two curved or dished screens arranged with their peripheral edges abutting and with their central portions spaced apart to form an air/water mixing chamber between them. The screens, in one embodiment, are integrally joined together along a portion of their peripheries.

The aerator includes support means on the housing for supporting the screen arrangement by its peripheral edge on one side. A perforated member is mounted in the housing upstream from the air openings and a central spacer projects downstream to hold the screen arrangement against the support means.

4 Claims, 2 Drawing Sheets

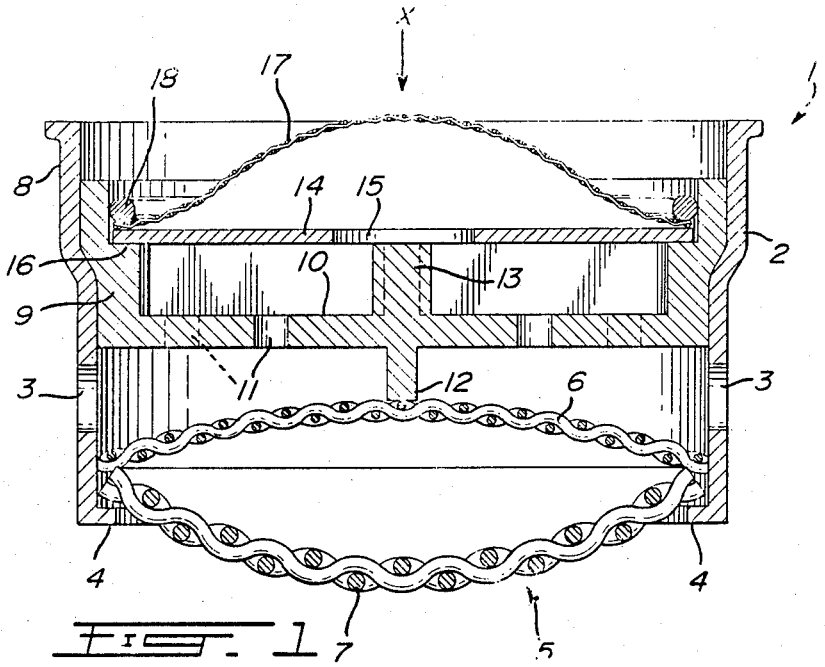
FIG. 1
FIG. 2
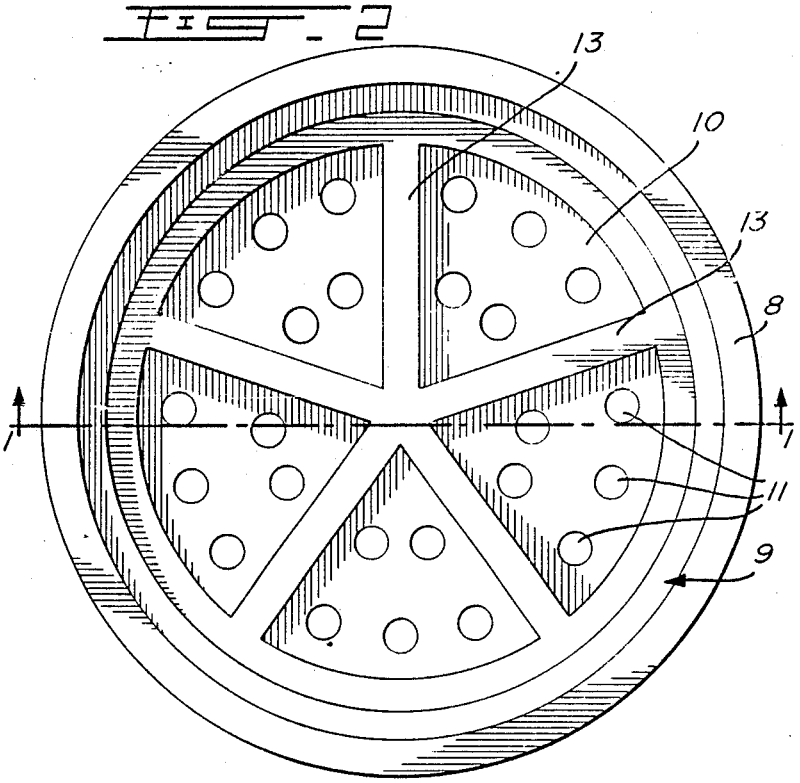

FAUCET AERATOR

This invention is directed toward a faucet aerator with a cylindrical housing containing air slots and having, below the latter, screens inserted in the housing. The aerator is insertable in a cylindrical casing which in turn attaches to the faucet nozzle.

Aerators are designed to add air to water flowing from faucets. To this end, air flows laterally into the aerator, through air slots in the housing, and this air is mixed with the flowing water to increase the flow and to muzzle the attendant noise. Below the air slots there are a number of separate screens which split the water stream and thus behind each screen a thorough mixing of the divided water stream with air occurs. These screens are flat, or nearly so, and have on their peripheral edges spacer flanges, so that the adjoining screens come to rest on each other by way of their flanges, thereby causing separation of adjacent screens.

Conventional aerators have proved their effectiveness. However, one disadvantage is that the manufacture of spacer flanges of the individual aerator screens involves certain costs, and in addition in the course of time the outer or downstream screens may tend to become clogged.

The purpose of the present invention is to provide an aerator of the described kind which is cheaper to produce than the conventional ones but which ensures at the same time that a thorough water/air mixing results.

This problem is solved in that at least one lenticular screen arrangement, consisting of two screens, is provided.

On account of the lenticular screen arrangement, both screens of the arrangement can be stacked directly on their peripheral edges without needing any spacer flanges. Each screen has a curved surface and both screens are assembled in a lenticular arrangement in such fashion that the screens are curved in opposite directions. Production of these screens is extremely simple, it only being required that they are punched out individually and curved.

The screens may be fabricated from metal or plastic material, and be either in a mesh or perforated form. Tests have demonstrated that optimal water/air mixing results whenever the screen arrangement consists of a coarse screen and a fine screen, the former positioned downstream of the latter. Even two coarse screens produce a satisfactory water flow and for optimal water/air mixing it suffices that there be only a single lenticular screen arrangement.

When using the coarse screen downstream of the fine screen in a preferred embodiment, the aerator based on this invention records a longer lifespan due to delayed calcium deposit formation thereon. This is because the coarse screen, after discontinuation of the water flow through the aerator not only retains less water but the mineral deposits caused by the evaporation of residual water clogs up the winder mesh at a slower rate.

Low cost production of the screens and of screen arrangements arises if two screens similarly curved in the same direction are joined at their periperhal edges by a crosspiece, and then one screen is folded relative to the other to form the lenticular screen arrangement. The screens joined by a crosspiece can be formed simultaneously, and by folding the screens in such manner that their edges are stacked and the curving of the screens goes in opposite directions, a lenticular screen arrangement is formed.

Aerators normally have, above the air slots in the housing, a round cap-shaped perforated part, which splits the water stream before the air slots, so that in this area there is already an increased water/air mixing. The side of the perforated part facing the screen arrangement has at least one spacer, the outer end of which lies against the upper or upstream screen in the arrangement. Owing to the configuration of the perforated part and its spacer, the latter presses the upstream screen against the lower or downstream screen, ensuring that the position of the screen arrangement is maintained in the housing.

A particularly satisfactory water flow by using the new screen layout is obtained when combining it with a flow restricting or controlling device located above the perforated part.

Ideally such flow restricting device consists of a relatively flexible disk placed on the upstream surface of the perforated part, which is ribbed. the disk has at least one cutout for a diminished flow cross section. The ribbing on the surface of the perforated part preferably runs radially from the center outwards. The cutout in the relatively flexible disk is ideally formed by a central aperture. Water entering the housing runs via this central aperture into a hollow space between the disk and the perforated part. The water flow is divided in the hollow space by the ribbing, and then flows through the perforated part, past the air slots, and reaches the screen arrangement. Due to the central aperture, the water flows above the air slots mainly in the middle of the faucet nozzle and only gets diffused further on. Aside from improved water/air mixing it is possible to modify the water flow through the faucet nozzle by chosing different aperture sizes in the disk. Further adjustment can be achieved by the relatively flexible nature of the disk, so that at high water pressure it is pressed partially into the ribbing channels.

The housing above the perforated part and above the disk ideally has fitted thereto an outward-curved screen, preferably a fine gauge screen, for the function of filtering out large dirt particles in the water flow. This screen should be installed in the housing so as to permit easy removal, cleaning and repositioning.

The invention will now be described in detail having reference to the accompanying drawings in which:

FIG. 1 represents a front cross section view of the aerator, of the present invention;

FIG. 2 is the top view thereof, minus certain components;

Figure 3:
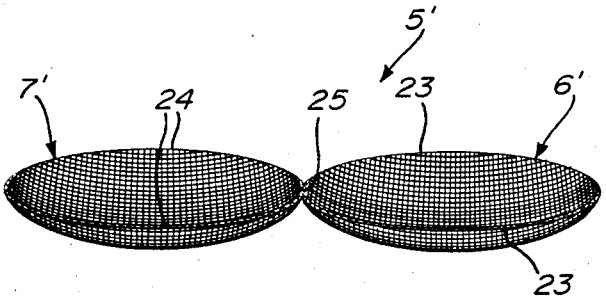
FIG. 3 is a perspective view of two screens joined together.

FIG. 1 shows an aerator 1 having a cylindrical housing 2 with air slots 3, in the wall of the housing. A number of these air slots are distributed about the housing 2. Water flows through this housing 2 in FIG. 1 from top to bottom. On its lower end, the housing has a surrounding support part 4 oriented inwards, which supports the screen arrangement 5 that is inserted at assembly from the top of the housing 2. The screen arrangement 5 consists of two screens assembled in a lenticular arrangement. The upper or upstream screen 6 is curved upwards and the lower or downstream screen 7 is curved downwards. The peripheral edges of the screens 6 and 7 rest against each other in the housing 2. As may be observed from FIG. 1, the upper screen 6 is fine mesh and the lower screen 7 is coarse mesh. The screens are preferably produced from a metal wire and the diameter thereof in the coarse screen should be 0.5 mm. The coarse screen can have a mesh size of about 0.8 mm, while the diameter of the fine screen wire should be around 0.15 to 0.20 mm, with the fine screen having a mesh size of 0.1 to 0.2 mm.

The upper part 8 the housing 2 is of a greater inside diameter than the lower part. Housing 2, in the area of the upper part 8 accepts a round cap-shaped part 9, having in its bottom wall 10, a number of holes 11. A spacer 12 projects down from wall 10 toward the screen arrangement 5 and contacts upper screen 6 of the arrangement 5.

The spacer 12 ensures that part 9 holds the screen arrangement 5 in its position in aerator 1. The upper suface of the bottom wall 10 of part 9 has ribs 13 radiating from its middle. The ribs 13 support relatively flexible disk 14 equipped with a central flow restricting aperture 15. This disk 14 rests on the ribs 13 and also on a circular shoulder 16 formed above wall 10 on part 9. Above disk 14 sits a fine screen 17 which is curved upstream. A flexible ring 18, held by part 9, prevents the screen 17 and the disk 14 from separating from part 9. FIG. 2 is a top view of the aerator shown in FIG. 1, minus ring 18 fine screen 17 and disk 14.

Figure 4:
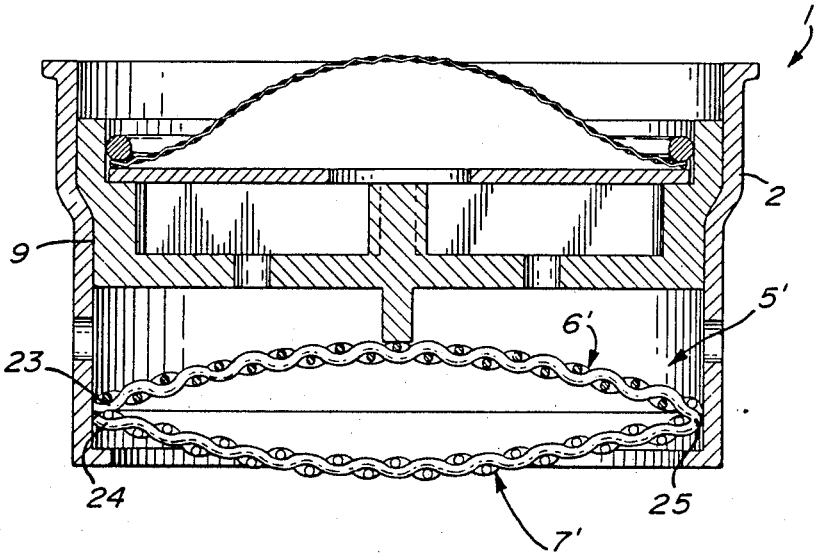
FIG. 4 is a cross-section view, similar to FIG. 1, showing the two screens of FIG. 3 installed in the housing.

The screen arrangement 5′ can consist of two screens 6′, 7′ assembled in a lenticular arrangement with the screens joined at their peripheral edges 23, 24 by a crosspiece 25 as shown in FIG. 3. The two screens 6′, 7′ joined by crosspiece 25 are first formed simultaneously with both screens 6′, 7′ curved or dished in the same direction. Screen 6′ is then folded about crosspiece 25 to overlie screen 7′ with their edges 23, 24 directly abutting. The screens 6′, 7′ form the lenticular screen arrangement 5′ as shown in FIG. 4 with the upstream screen 6′ dished in an upstream direction and with the downstream screen 7′ dished in the downstream direction. The screens 6′, 7′ and crosspiece 25 have the same mesh size.

I claim:

1. A faucet aerator having: a cylindrical housing with air slots therein; a lenticular screen arrangement in the housing downstream from the air slots, the screen arrangement consisting of two screens comprising an upstream screen dished in the upstream direction and a downstream screen dished in the downstream direction and with the peripheral edges of the screens directly abutting each other and with their central portions spaced apart to form a lenticular-shaped air/water mixing chamber between the screens; support means on the housing to support the screen arrangement on one side by the peripheral edges of the screens; a perforated member mounted on the housing upstream from the air slots, the perforated member having means bearing on the other side of the screen arrangement to hold it against the support means, radially extending ribs on the upstream surface of the perforated member forming radially extending channels leading to the perforations; and a relatively flexible disk; having a single centrally located flow restricting aperture communicating with the inner ends of the channels.

2. A faucet aerator as claimed in claim 1 wherein the two screens are separate with the upstream screen being a fine screen and with the downstream screen being a coarse screen.

3. A faucet aerator as claimed in claim 1 wherein the two screens are of the same mesh size joined at their peripheral edges by a crosspiece.

4. A faucet aerator as claimed in claim 2 wherein the fine screen has a mesh size of 0.1 to 0.2 mm. and the coarse screen has a mesh size of 0.8 mm.

* * * * *